United States Patent [19]

Garland

[11] 4,324,109

[45] Apr. 13, 1982

[54] ICE-MAKING APPARATUS WITH HOT GAS DEFROST

[75] Inventor: Milton W. Garland, Waynesboro, Pa.

[73] Assignee: Frick Company, Waynesboro, Pa.

[21] Appl. No.: 242,219

[22] Filed: Mar. 10, 1981

[51] Int. Cl.[3] ..... F25C 5/10

[52] U.S. Cl. ..... 62/353; 62/73

[58] Field of Search ..... 62/73, 353, 233

[56] References Cited

U.S. PATENT DOCUMENTS

| | | | |
|---|---|---|---|
| 2,239,234 | 4/1941 | Kubaugh | 62/164 |
| 2,618,129 | 11/1952 | Williams, Jr. | 62/106 |
| 2,721,451 | 10/1955 | Brandin et al. | 62/352 X |
| 2,739,457 | 3/1956 | Chapman | 62/107 |
| 2,807,150 | 9/1957 | Chapman | 62/7 |
| 2,870,612 | 1/1959 | Garland | 62/138 |
| 3,053,058 | 9/1962 | Kocher | 62/233 |
| 3,206,945 | 9/1965 | Nilsson et al. | 62/352 |
| 3,280,585 | 10/1966 | Lowe | 62/347 |
| 3,435,633 | 4/1969 | Dixon | 62/352 |
| 3,759,061 | 9/1973 | Nilsson et al. | 62/352 |
| 3,769,812 | 11/1973 | Gordon | 62/352 |
| 3,807,152 | 9/1957 | Chapman | 62/107 |
| 4,094,168 | 6/1978 | Hamner et al. | 62/347 |

*Primary Examiner*—William E. Tapolcai, Jr.
*Attorney, Agent, or Firm*—Dowell & Dowell

[57] ABSTRACT

A tube shell ice-maker has a false bottom compartment in which trapped refrigerant gas is present to prevent ice formation around the bottom during ice-making and from which during defrosting hot gaseous refrigerant flows upwardly into the refrigerant within the tubes, the liquid remaining within the tubes, whereby delay in initiating further ice-making is minimized.

6 Claims, 3 Drawing Figures

ICE-MAKING APPARATUS WITH HOT GAS DEFROST

TECHNICAL FIELD

This invention relates to refrigeration and more particularly to efficiently making shell ice on tubes with a minimum delay between cycles.

BACKGROUND ART

Refrigeration equipment for making ice on or within refrigerated tubes has been known for many years. The present invention is an improvement over that disclosed in my U.S. Pat. No. 2,870,612 entitled Ice-Making Apparatus. In that patent, in order to release the ice, the freezing tubes were isolated from the evaporator and hot gaseous refrigerant was employed to force all of the liquid out of the tubes and to raise the pressure. Such system inherently involves a delay in removing the liquid from the tubes and in bringing liquid back into the tubes for ice-making during each cycle.

Other patents in the art include U.S. Pat. Nos.: Williams 2,618,129; Chapman 2,807,152; 2,739,451 and 2,807,150; Kocher 3,053,058; Lowe 3,280,585; Gordon 3,769,812; Hamner 4,094,168; Nilsson et al 3,206,945; Kubaugh 2,239,234; and Dixson 3,435,633.

SUMMARY OF THE INVENTION

The present invention includes in a tube shell ice-maker, the provision of a false bottom above an enclosed space in the tubes which contains trapped gaseous refrigerant during freezing and which has valve means permitting hot gaseous refrigerant to flow upwardly into the liquid refrigerant during defrosting where it condenses, thereby providing the required heat for freeing of the ice on the tubes. The time for defrosting and for recommencing ice-making is relatively short since the charge of liquid refrigerant is substantially maintained in the tubes at all times. Appropriate controls for automatically running the equipment through continuing cycles is provided.

Accordingly, it is an object of the invention to provide a tube shell ice-maker which provides for the efficient manufacture of a uniform shell of ice, releasing it from the tube on which it is formed and commencing the formation of the next shell of ice with minimum delay.

DESCRIPTION OF THE PREFERRED EMBODIMENT

Freezing Apparatus

Figure 1:
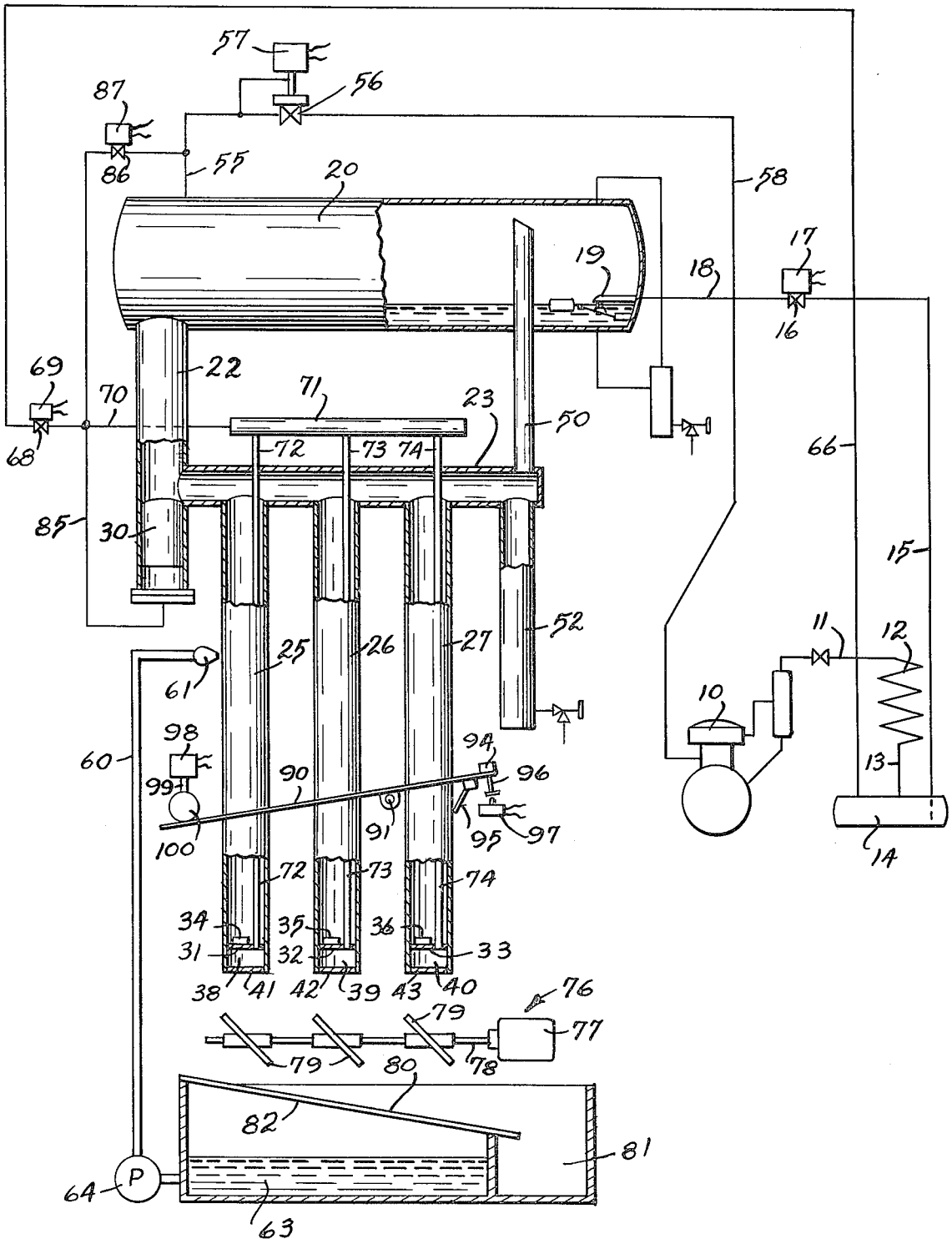
FIG. 1 is a schematic illustration of ice-making apparatus in accordance with the present invention.

With continued reference to the drawings, there is illustrated a conventional compression type refrigeration system including a compressor 10 which discharges into a line 11 to a condenser 12, and line 13 to refrigerant receiver 14. From the latter, line 15 delivers liquid refrigerant to valve 16 operated by solenoid 17 to line 18 to a liquid level control valve 19 whose purpose is to maintain a predetermined level of liquid refrigerant inside separator-accumulator 20.

From separator-accumulator 20 there is a liquid downflow conduit 22 into header 23 which feeds liquid to ice-making tubes 25, 26 and 27. Flow from conduit 22 into the header 23 normally is controlled by piston type valve 30 whose operation will be described later.

At the lower ends of the tubes 25, 26 and 27 there are false bottom forming base plates 31, 32 and 33 having valves 34, 35 and 36, respectively. The details of the false bottoms and the valves will be described separately in connection with FIG. 3.

During the freezing cycle, the valves 34, 35 and 36 are closed and prevent liquid refrigerant from entering the spaces 38, 39 and 40 between the false bottoms 31, 32 and 33 and the lower bottoms 41, 42 and 43. Thus, gas is trapped therein and ice is not formed on the outside during the freezing mode. From the header 23, spaced from conduit 22, a return conduit 50 for gaseous refrigerant extends to the upper portion of the separator-accumulator above the liquid level therein. Below the header 23 a conduit 52 is provided for oil collection is accordance with standard practice.

From the upper portion of the separator-accumulator, a vapor return line 55 is connected to valve 56 controlled by solenoid 57 to line 58 to the suction side of the compressor 10.

Equipment for flowing water onto the tubes is similar to that disclosed in my patent 2,870,612. It includes a supply pipe 60 for discharging water through nozzles 61, the water freezing on the tubes and the excess falling into the container 63 from which it is recirculated by pump 64.

Defrosting and Harvesting Apparatus

In order to remove the ice from the tubes, provision is made for the introduction of hot gaseous refrigerant during the time (a) that the flow of water onto the tubes is stopped, (b) the feed of liquid refrigerant from the separator-accumulator into the header is stopped, and (c) the suction outlet is set at a preset pressure corresponding to the desired refrigerant thawing temperature.

From the receiver 14, a line 66 for hot gaseous refrigerant extends from the upper portion of the receiver to a valve 68 controlled by solenoid 69 to line 70 to header 71 from which it flows through the small down pipes 72, 73 and 74 within the respective tubes 25, 26 and 27 leading to the enclosed spaces or compartments 38, 39 and 40 at the bottoms thereof. From the bottom compartments of the tubes, the hot gaseous refrigerant raises the valve members of the valves 34, 35 and 36, respectively, and passes into the refrigerated spaces of the tubes 25, 26 and 27. Within the tubes the cold areas condense the incoming vapors, thereby warming the refrigerant inside of the tubes, and thus freeing the sleeve of ice on the outer surfaces thereof. The sleeves of ice slide downwardly from the tubes into contact with a conventional breaker member 76 including a power plant 77 which drives a shaft 78. One or more breaker bars 79 are mounted on the shaft below each tube and such breaker bars break the ice sleeves into chunks or fragments which fall by gravity onto a grid 80. Such grid is inclined to deflect the ice chunks into a collecting area 81 from which they may be removed in any conventional manner.

In order to stop the refrigerant feed during defrosting and harvesting, there is a line 85 from line 70 which is connected to the piston valve 30 that controls flow from the separator-accumulator down pipe 22 into the header 23. Thus, when hot gas flows into valve 68 into line 70, it causes the valve 30 to move into closed position. Line 85 is connected to line 55, the vapor return line from the separator-accumulator 20, through valve 86 controlled by solenoid 87. Valve 86 is closed by solenoid 87 during the defrosting and harvesting cycle.

Valve 56, in the return line 55, is a special valve which is fully open when solenoid 57 is de-energized during ice-making. During the defrosting and harvesting cycle, solenoid 57 is energized to partially close valve 56 so that it then functions as an upstream pressure-regulator which can be preset for any desired pressure-temperature for raising the liquid temperature in the ice-making tubes.

In order to start a new ice-making cycle as soon as the ice has been removed from the tubes, ice sensing control apparatus is employed of the kind described in my patent 2,870,612. This includes harvest arm 90 which is connected to a shaft 91 that is mounted for oscillation between supporting standards, not shown, as described in my earlier patent. The arm has a weight 94 at one end which tends to rotate the shaft clockwise as viewed in FIG. 1 until the tips of fingers 95 contact the tubes 10, thereby stopping further rotation of the shaft 91. An adjusting screw 96 is connected to the underside of the arm 90 adjacent to the weight 94 for contacting a microswitch 97 whose purpose will be described later.

Adjacent to and suitably mounted above the remote end of the arm 90 is a solenoid 98 which has a core 99 to which a weight 100 is attached. The solenoid is so disposed adjacent to the arm 90 that during the ice-making portion of the cycle the weight 100 rests on the arm 90 and is sufficient to more than counterbalance the weight 94 to maintain the shaft in such position that the fingers 95 are spaced from the tubes sufficiently far that they do not interfere with the formation of ice thereon or become frozen into the ice.

Control System

As generally described in U.S. Pat. No. 2,870,612, the apparatus is set to operate for a cycle of predetermined time depending on the thickness of ice desired to be formed on the tubes. In the present apparatus, a nominal 12 minute cycle may be employed. The same general type of programming is employed with the present apparatus as in my U.S. Pat. No. 2,870,612.

Figure 2:
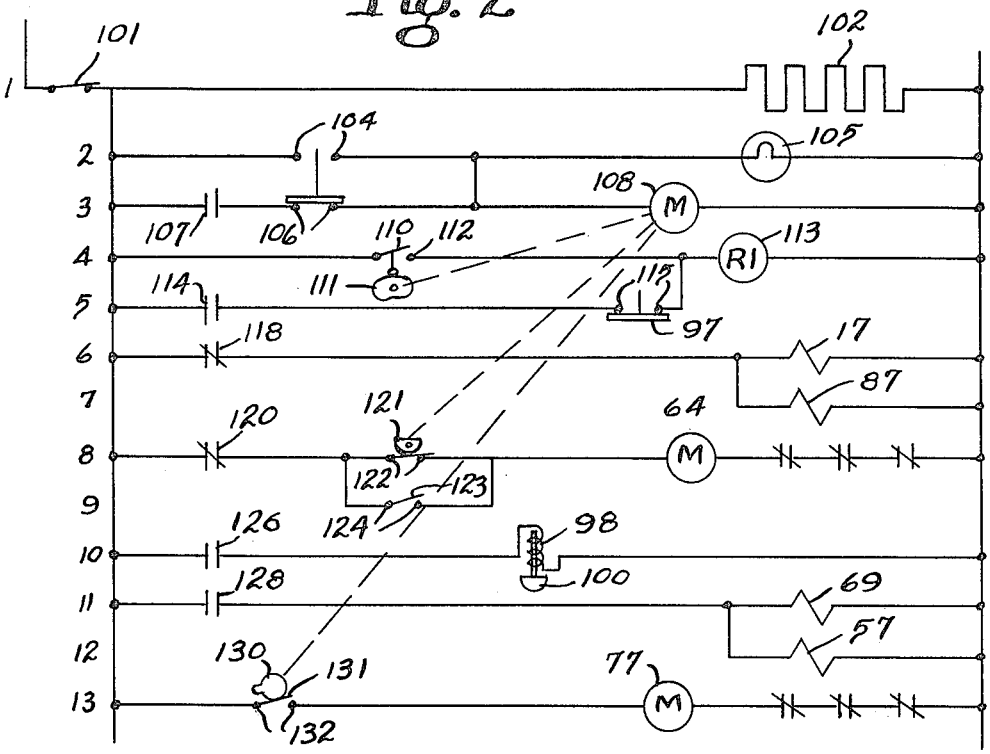
FIG. 2 is a schematic diagram of the control circuit for operating the apparatus of FIG. 1.

With reference to FIG. 2, the controls are illustrated in condition during freezing. Line 1 has a manually controlled on-off switch 101 and a resistance type heater 102 which is placed inside the control box to avoid the condensation of moisture therewithin.

Line 2 includes a manually operated harvester switch member 103 with normally open contacts 104 and a signal light 105. When contacts 104 are closed, the ice-maker program device may be manually checked.

In line 3, normally closed contacts 106 are bridged by switch 103, the line including an interlock switch 107 for the compressor and a programmer motor 108. Line 4 includes a switch 110 whose position is controlled by the rotary cam 111 that is driven by the motor 108, the switch operative to bridge contacts 112 and thereby energize relay R1, 113. Line 5 includes R1 relay contact 114 which is open when relay 113 is not energized as illustrated in FIG. 2, during the freezing portion of the cycle. Line 5 also includes contacts 115 of microswitch 97 which are opened at the conclusion of harvesting.

Line 6 includes normally closed R1 relay contact 118 in line with solenoid 17 controlling valve 16 in the liquid line 15 from the receiver 14. Line 7, connected to line 6 under control of relay contact 118 has solenoid 87 which controls valve 86, maintaining it in open position during freezing. Line 8 includes normally closed R1 relay contact 120, rotary cam 121 driven from programmer motor 108 and bridging contacts 122 during freezing thereby operating the water pump motor of pump 64. Auxiliary switch 123 in line 9 may bridge contacts 124 in a bypass around contacts 122 for manual operation of the water pump if desired.

Line 10 includes normally open R1 relay contacts 126 which control the energization of solenoid 98 and weight 100, thereby permitting the weight to hold the arm 90 in the position illustrated in FIG. 1 during freezing. Line 11 includes normally open R1 relay contacts 128 in line with solenoid 69 for valve 68 in the hot gas line 66. Line 12 has connected to the same line solenoid 57 for valve 56 in the suction line 55, 58 to the compressor. Thus, during freezing both of these solenoids are not energized, valve 68 being closed and valve 56 being open. Line 13 includes a rotary cam 130 driven from programmer motor 108 and controlling switch 131 which may bridge contacts 132, the line controlling energization to the motor 77 of the ice breaker member 76. The cam 130 is designed to close the circuit across contacts 132 a few seconds prior to the end of the nominal 12 minute cycle.

Operation

The condition of the controls as illustrated in FIG. 2 has been described during the freezing operation. As stated above, a few seconds prior to the end of the nominal 12 minute cycle, cam 130 closes a circuit to the ice breaker 76 to cause its operation. At the end of the ice-making operation, cam 111 in line 4 closes switch 110, thereby energizing relay R1, 113. At the same time, the end of harvest switch 97 closes contacts 115 to lock up relay R1, 113 until the harvesting mode is completed. Energizing relay 113 breaks the circuits in lines 6 and 8 causing valves operated by solenoids 17 and 87 to close, thereby stopping the flow of liquid refrigerant through lines 15 and 18, stopping the flow of gaseous refrigerant through line 85 to the vapor return line 55, and stopping the water pump 64. Energizing relay 113 also causes the circuits in lines 10 and 11 to be completed, thereby lifting the weight 100 from the harvest arm 90 and opening the hot gas valve 68 and closing valve 56, thereby causing it to act as a pressure regulator at a preset condition.

The refrigeration vapor from the receiver 14 via conduit 66, valve 68, line 70 and header 71 enters the down pipes 72, 73 and 74 leading to the bottom areas of the tubes and the high pressure gas passes through the valves 34, 35 and 36 through the refrigerated area of the tubes, thereby thawing the ice free from the tubes. The compressor is not stopped during defrosting, but continues to run, thereby providing hot gas during defrosting. While the hot gas condenses within the tubes and adds liquid condensate into the normal freezing area, the separator-accumulator is sized to handle the added liquid volume. When the ice has fallen from each tube, the end of the harvest arm 90 with the weight 94 falls and breaks the end of harvest switch 97 in line 5, thus de-energizing relay 113 in line 4 and putting the controls into the freezing or ice-making position.

The False Bottom and Valve Means

Figure 3:
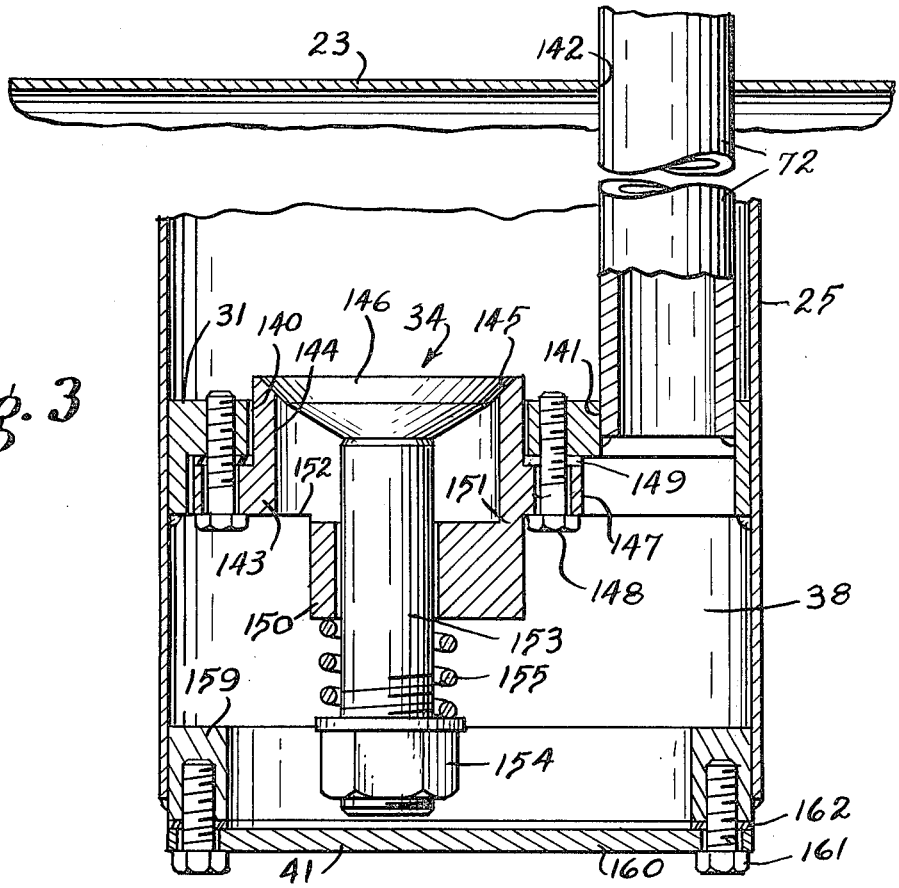
FIG. 3 is an enlarged section through the bottom of one of the tubes illustrating the details of the false bottom and the valve means therein.

The details of the false bottom and valve means are illustrated in FIG. 3. Thus, a representative false bottom forming base plate 31 has an opening 140 for receiving a valve 34 and a smaller opening 141 for receiving one end of a hot gas pipe 72, the other end of the hot gas pipe extending through an opening 142 in the top of the header 23 and being connected to the header 71. In assembling the tube, the lower end of tube 72 is fixed by weld to the base plate 31 and then the base plate 31 with the attached pipe 72 is inserted into and through the tube 25 so that the pipe passes through the opening 142 at which point it is welded and then the upper end of the pipe is welded to the header 71 in a manner such that the pipe communicates with such header. The base plate 31 then is welded or otherwise attached to the inner periphery of the tube 25 in spaced relationship with the lower end thereof to define the upper wall of the space 38.

The valve 34 includes a valve body 143 having an axial bore 144 and a valve seat 145 at one end which normally engages a valve member 146. The valve body has a generally circular outwardly extending flange 147 which is attached to the base plate 31 by suitable fasteners 148 with a gasket 149 therebetween. A spider or guide sleeve 150 is attached to the valve body 143 by arms 151 and the spaces 152 between such arms define openings which provide communication between the bore 144 and the space 38. The valve member 146 is connected to a stem 153 which extends through the guide sleeve 150 and the lower end of such stem threadedly receives an adjustable fastener such as a nut 154. A compression spring 155 is positioned between the guide sleeve 150 and the fastener 154 to urge the valve member 146 into intimate engagement with the valve seat 145.

In order to provide a bottom wall for the tube 25 and the space 38, a ring 159 is positioned within the lower extremity of the tube 25 and is welded thereto. A cover plate 160 is secured to the ring 159 by suitable fasteners 161 with a gasket 162 therebetween.

During the harvesting operation hot gas under pressure passes downwardly through the pipe 72 and is discharged into the space 38. When the pressure within the space builds up enough to overcome the spring 155, the valve member 146 is moved away from the valve seat 145 so that the gas within the space 38 is dischaged into the liquid refrigerant above the base plate 31. When the harvesting operation is completed, the valve 68 is closed so that gas flow to the heater 71 is interrupted and the spring 155 will automatically move the valve member into engagement with the valve seat.

While the system described above has been found to work satisfactorily using the piston valve 30, it has also been found by experimentation that such piston valve could be omitted at least under certain circumstances. In the event that the piston valve is omitted, the line 85 and valve 86 which is operated by the solenoid 87 also may be omitted.

I claim:

1. Apparatus for producing ice comprising vertical tube means, means for applying water to the exterior of said tube means, a header communicating with said tube means, an accumulator-separator for refrigerant, a first conduit from the lower portion of the accumulator-separator to the header for supplying liquid refrigerant thereto, a second conduit from the upper portion of the accumulator-separator connected to the header for withdrawing gaseous refrigerant, said conduits being connected to spaced portions of the header whereby liquid and gaseous refrigerant flow through the header in the same direction during ice-making, said tube means having a false bottom at its lower portion which constitutes a wall of an enclosed space, valve means in said false bottom, means urging said false bottom valve means into closed position, the weight of liquid refrigerant in said tube means tending to close said valve means, and means for supplying relatively high temperature and pressure gaseous refrigerant to the space beneath the false bottom for opening said valve means to permit gaseous refrigerant to flow upwardly into said tube means and to cause release of ice from the outer surface thereof.

2. The invention of claim 1, and means connecting said accumulator-separator to refrigerant compressor means, and pressure regulating means in said connecting means operative during defrosting of said tube means.

3. The invention of claim 1 including second valve means in said first conduit for controlling flow therethrough, and means for closing said second valve means in response to flow of said gaseous refrigerant to said space beneath said false bottom.

4. The invention of claim 1, and means for supplying liquid refrigerant to said accumulator-separator during ice-making, and stopping said supply during defrosting of said tubes.

5. In apparatus for producing ice on vertical tube means in which a supply of liquid refrigerant is maintained during freezing, the improvement comprising, said tube means having a false bottom which constitutes a wall of an enclosed space therebeneath, means for providing for delivery of hot gas refrigerant into said space, valve means in said false bottom, said valve means including valve seat means, a valve member mounted for reciprocation relative to said valve seat means, said valve member having stem means extending into sid space, spring means engaging said stem means and tending to keep said valve member seated, the underside of said valve member communicating with said space, said spring means and said valve means being so constructed and arranged that hot gas delivered into said space is operative to raise said valve member off its seat and permit said hot gas to flow upwardly into said tube means.

6. The invention of claim 5 in which said hot gas is brought to said space by conduit means passing downwardly inside of said tube means.

* * * * *